United States Patent [19]

Baumann

[11] 4,387,894

[45] Jun. 14, 1983

[54] BENCH-TYPE EXERCISER DEVICE

[75] Inventor: René Baumann, Lucerne, Switzerland

[73] Assignee: Wiba AG, Kriens, Switzerland

[21] Appl. No.: 269,022

[22] PCT Filed: Sep. 18, 1980

[86] PCT No.: PCT/CH80/00108

§ 371 Date: May 29, 1981

§ 102(e) Date: May 29, 1981

[87] PCT Pub. No.: WO81/00967

PCT Pub. Date: Apr. 16, 1981

[30] Foreign Application Priority Data

Oct. 3, 1979 [CH] Switzerland ..... 8892/79

[51] Int. Cl.[3] ..... A63B 21/00

[52] U.S. Cl. ..... 272/130; 272/141; 272/143; 272/DIG. 4

[58] Field of Search ..... 272/132, 136, 135, 141, 272/143

[56] References Cited

U.S. PATENT DOCUMENTS 3,103,357 9/1963 Berne ..... 272/132

3,856,297 12/1974 Schnell ..... 272/132 X 4,314,697 2/1982 Brumfield et al. ..... 272/136

*Primary Examiner*—Richard C. Pinkham

*Assistant Examiner*—William R. Browne

*Attorney, Agent, or Firm*—Watson, Cole, Grindle & Watson

[57] ABSTRACT

A bench type exerciser device has a pad (6) which is swivel-mounted on a rotatably mounted lever (5). This lever (5) is swingably connected, via a connecting member (17), to one end of an arcuate lever arm (13), the other end of which is hinged to a lockable lever (10) which is threadingly mounted about the shaft (2). A lockable sliding element (14) is connected to the arcuate lever arm (13), to which is hinged one end of a pneumatic spring (16) while the other end of the pneumatic spring is fixedly hinged to the shaft (2). The pad (6), which is affixed to the lever (5), serves to exercise the back muscles of a person who is lying prostrate on a reclining surface (18) and who must lift, with his back, the pad (6) against a resisting force. The lockable lever (10) serves to alter the initial position of the rotatably mounted lever (5), so that the starting angle of the body of the exercising person can be individually chosen.

5 Claims, 2 Drawing Figures

Fig. 1
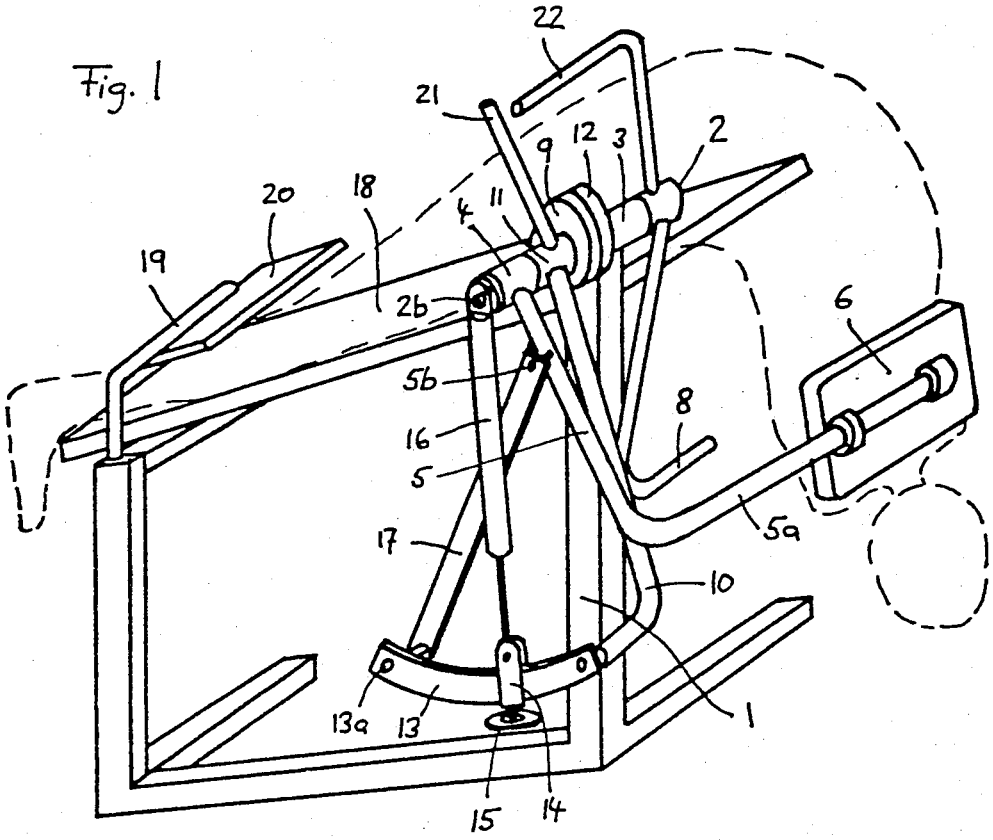
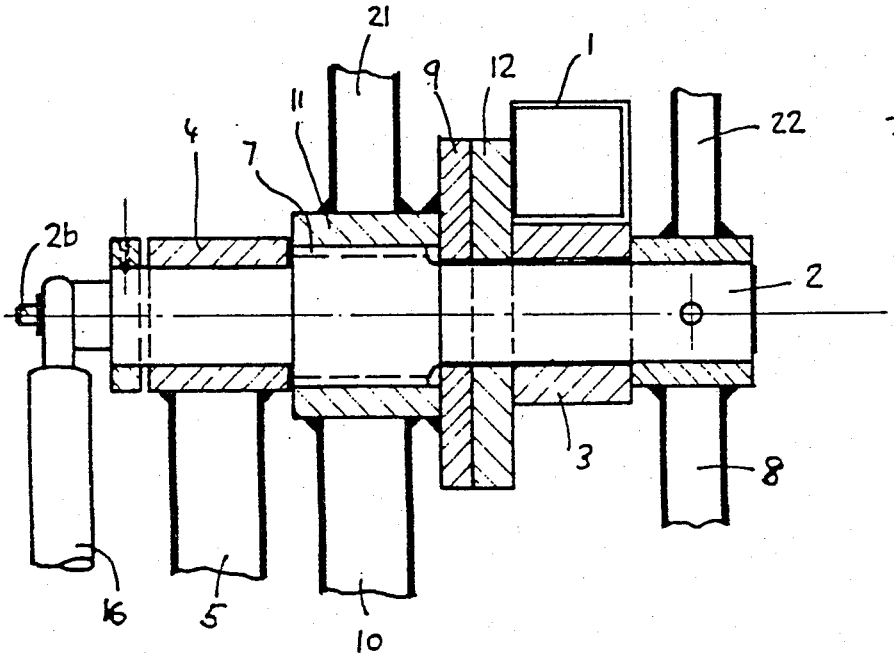
Fig. 2

BENCH-TYPE EXERCISER DEVICE

The invention relates to an excerciser device, more particularly to a bench-type exerciser device which is particularly adapted for exercising the back muscles of a user, the exerciser device including an operating lever actuated against a resisting force and to which a pad is affixed.

Exerciser devices are known in the art where, on an inclined bench and under the influence of gravitational forces, the upper body of the user is moved rearwardly and upwardly. The increase of the resisting force is such that an extra weight, e.g., a medicine ball, is held on the back of the neck. In another type of exercise, the upper body is pressed rearwardly and upwardly, while the body is stretched out on the floor.

The object of the present invention is to provide a bench-type exerciser device wherein extra resisting force can be freely and continuously selectable in a specified area and the force characteristic during the movement can be from a 90° angle to the stretched-out position, from a low value over a maximum to a lower value. This is desirable because the torque of the body in both extreme angular positions is smaller. Moreover, the exercising person shall have ease of entry in that the pad can be swung forwardly and upwardly and, at the start of the exercise, can be held in the desired individual starting position.

To solve the above problem, the exerciser device according to the present invention is characterized in that on a shaft placed in an equipment frame two levers are mounted in the axial direction one behind the other, the first lever rotating about the shaft and carrying on an offset lever arm a movable back pad is hinged, via a connection element, to one end of an arcuate lever arm, the other end being hinged to a second lever, the arcuate lever arm being connected to one end of a resisting element which can be adjusted along the lever arm, and the other end being fixedly hinged with respect to the equipment frame, the second lever capable of being locked with the back pad on the shaft in any angular position relative to the initial position of the first rotating lever with the object of altering the initial position of the first lever.

Preferably, the resisting force is produced by a pneumatic spring consisting of a piston/cylinder unit which has the advantage that it permits adjustment under no-load condition owing to the existing longitudinal dead limit, during which the compressive force approximates zero.

Other objects and advantages of the present invention will become apparent from the ensuing description given hereinafter and in the drawings, in which an embodiment of the invention is shown merely by way of example.

DESCRIPTION OF THE DRAWINGS

FIG. 1 is a diagrammatic representation of the inventive exerciser; and

FIG. 2 is a cross-sectional view taken through the shaft of the exerciser shown in FIG. 1.

In an equipment frame 1 having a bearing 3 there is mounted a shaft 2 to which an operating lever 8 and an arm 22 are fixedly connected. A lever 4,5, which is freely rotatable about the shaft 2 carries on its offset portion 5*a* a swivelable pad 6. This lever 5 is hinged by means of a pin 5*b* to a connecting member 17. This connecting member 17 is pivotally connected by means of another joint pin 13*a* to one end of an arcuate lever arm 13. A second lever 10 is hinged to the other end of this arcuate lever arm 13. A sliding element 14 with locking device 15 can slide along this arcuate lever arm 13 and be locked in any position therealong. One end of a pneumatic spring 16 is hinged to this sliding element 14, while the other end is hinged to the shaft 2 at 2*b*. This end of the pneumatic spring can also be hinged to a pin of the lever 10 (this alternative not shown). The lever 10 is affixed to a threaded bushing 11 placed on a threaded segment 7 of the shaft 2 and carries on its front a washer 9 which can produce frictional contact with an opposing washer 12 which is mounted with clearance on the shaft 2 and is fixed with respect to the equipment frame 1. By pivoting the operating lever 8 against the center of the reclining surface 18 by the person using the exerciser, the washer 9 is pressed against the opposing washer 12, thereby locking the lever 10 in place. When the exercising person pushes the pad 6 upwardly, the connecting piece 17 transmits this motion to the arcuate lever arm 13 so that the pneumatic compression spring is compressed against resistance. Owing to the geometry of the lever, the resultant distances of the axes of force will behave in such a way that a force with an arcuate characteristic acts on the pad 6, that is to say, the torque is low at the start, reaches its maximum after half a movement and, after a 90°-angle, assumes another low value. In order to release the noted frictional contact between the washers 9 and 12, the operating lever 8 must be moved forward. After release of the frictional contact, the offset arm 22, which is also fixedly connected to the shaft 2, carries along the cam arm 21 and by this action the second lever 10 is rotated on the shaft 2. In this way, the whole lever system 5, 10, 13–17 can be swung forward in a counterclockwise direction (FIG. 1) without producing a resisting force.

When the back of the person using the exerciser is pressed against the pad 6, reaction forces of constraints arise. These forces are appropriately absorbed by the user's legs, e.g., against the pad 20 mounted on an arm 19 attached to the frame 1. A reclining surface 18 permits a more convenient exercise.

Summing up, the advantages of the above-described device over prior art exercisers is seen in the fact that with this device the resisting force of the exerciser can be continuously adjusted, the torque has an arcuate characteristic, and the initial position of the pad can be adjusted individually.

I claim:

1. A bench-type exerciser device particularly useful in exercising the back muscles of a user, said exerciser device including a frame means; a support means mounted on the frame means on which a user can lie; a bearing fixedly mounted on the frame means near a first end of the support means; a shaft rotatably mounted in the bearing; a first lever rotatably mounted on the shaft, said first lever including an arm portion which is positionable beyond said first end of the support means; a pad swivelably mounted on the arm portion of the first lever for contact with the back of a user; a second lever, a first end of said second lever being mounted on the shaft; a connecting member, a first end of said connecting member being rotatably connected to said first lever; an arcuate lever arm, one end of said arcuate lever arm being rotatably connected to the second end of said second lever and the opposite end of said arcuate lever arm being rotatably connected to the second end of said connecting member; an elongated resisting means, one end of said elongated resisting means being rotatably connected to the shaft and the opposite end of said elongated resisting means being adjustably connectable along the length o the arcuate lever arm, said elongated resisting means acting to resist movement of said arcuate lever arm; and means for locking said second lever with respect to rotation about the shaft, its angular position about the shaft altering the initial positioning of said first lever and thus the location of the pad relative to said first end of the support means.

2. The bench-type exerciser device as defined in claim 1 wherein the shaft includes a threaded portion along its length, wherein said second lever includes a threaded bushing which is threadingly connected around the threaded portion of the shaft, wherein the bearing includes a friction washer fixedly attached thereto on the side facing the threaded bushing of the second lever, wherein said second lever includes a friction washer fixedly attached thereto on the side facing the bearing, and wherein the means for locking said second lever with respect to rotation about the shaft includes a third lever fixedly connected to the shaft, movement in a first direction of said third lever causing the shaft to rotate relative to the bearing and said second lever to move towards the bearing, thus causing the friction washer of said second lever to lockingly engage with the friction washer of the bearing.

3. The bench-type exerciser device as defined in claim 2 wherein said third lever includes an offset arm portion, wherein said second lever includes a cam arm, and wherein movement of said third lever in a direction opposite to said first direction will cause the friction washer of said second lever to disengage with the friction washer of the bearing and then cause its offset arm portion to contact the cam arm of said second lever and said first lever to be rotated about the shaft.

4. The bench-type exerciser device as defined in claim 1 wherein the elongated resisting means comprises a pneumatic spring unit.

5. The bench-type exerciser device as defined in claim 1 wherein the opposite end of the elongated resisting means is adjustably connectable along the length of the arcuate lever arm by a sliding element which includes a locking means that is adjustable to fixedly attach the sliding element to a point along the length of the arcuate lever arm.

* * * * *